United States Patent [19]

MacLeod et al.

[11] Patent Number: 5,000,409

[45] Date of Patent: Mar. 19, 1991

[54] ONE PIECE WALL MOUNTING BRACKET

[75] Inventors: Richard J. MacLeod, Milford; Charles E. Schiedegger, Metamora, both of Mich.

[73] Assignee: Tapco Products Company, Inc., Detroit, Mich.

[21] Appl. No.: 445,787

[22] Filed: Dec. 4, 1989

[51] Int. Cl.[5] ..... A47B 96/00

[52] U.S. Cl. ..... 248/205.1; 362/147

[58] Field of Search ..... 248/205.1, 220.2, 30 D; 52/27, 28, 38, 211; 362/147, 148, 317, 432

[56] References Cited

U.S. PATENT DOCUMENTS

| | | | |
|---|---|---|---|
| 3,500,600 | 3/1970 | Bagley, Sr. | 52/211 |
| 4,635,168 | 1/1987 | Crowley | 362/147 |
| 4,726,152 | 2/1988 | Vagedes et al. | 52/28 |
| 4,854,093 | 8/1989 | Kellom | 52/28 |
| 4,887,195 | 12/1989 | Donelan | 362/147 |

*Primary Examiner*—Ramon O. Ramirez

*Attorney, Agent, or Firm*—Barnes, Kisselle, Raisch, Choate, Whittemore & Hulbert

[57] ABSTRACT

A one piece wall mounting bracket comprising a plastic body including a front wall and an integral peripheral wall extending from the front wall and having a free edge. Diametrically opposed portions of the free edge of the peripheral wall are formed with notches such that those peripheral portions can engage siding on wall of a building. The portions with the notches are preferably convex to firmly engage the siding. These wall portions can be readily severed to form a straight edge. A portion of the free edge of the wall is formed with a groove for receiving caulking. The groove is defined by a radially peripheral bead on the free edge which includes spaced walls forming the groove for receiving caulking compounds.

9 Claims, 2 Drawing Sheets

ONE PIECE WALL MOUNTING BRACKET

This invention relates to devices for mounting elements such as lighting fixtures, pipes or vents on the wall of a building which has siding there on.

BACKGROUND AND SUMMARY OF THE INVENTION

In the mounting of devices on the wall of the building having siding, it has been proposed in U.S. Pat. No. 4,726,152 that a bracket be provided which has a base member with a neck and a cap member with a neck which are telescoped together and riveted to one another after which the bracket is mounted on the wall of the building. The siding is then brought into position beneath the flange formed by the cap member. Such a bracket has also been molded in a one piece body. The problems with respect to such an arrangement are that is does not accommodate siding of varying thicknesses and is not universal in its application for mounting devices other then a light fixture. Where the siding is made of plastic the panels tend to be concave while the panels of insulated or wood siding are flat.

Among the objectives of the present invention are to provide an improved wall bracket which engages and accommodates the configuration of the siding on the building and which firmly engages the siding of the building to prevent the entry of water between the bracket and the siding.

In accordance with the invention a one piece wall mounting bracket comprises a plastic body including a front wall and an integral peripheral wall extending from the front wall and having a free edge. Diametrically opposed portions of the free edge of the peripheral wall are formed with notches such that those peripheral portions can engage siding on wall of a building. The portions with the notches are preferably convex to firmly engage the siding. These wall portions can be readily severed to form a straight edge. The free edge of the wall is formed with a groove for receiving caulking. The groove is defined by a radially peripheral bead on the free edge which includes spaced walls forming the groove for receiving caulking compound.

DESCRIPTION OF THE DRAWINGS

FIG. 1 is a fragmentary front elevational view of a wall mounting bracket embodying the invention on the side of a building having siding there on.

DESCRIPTION

Figure 3:
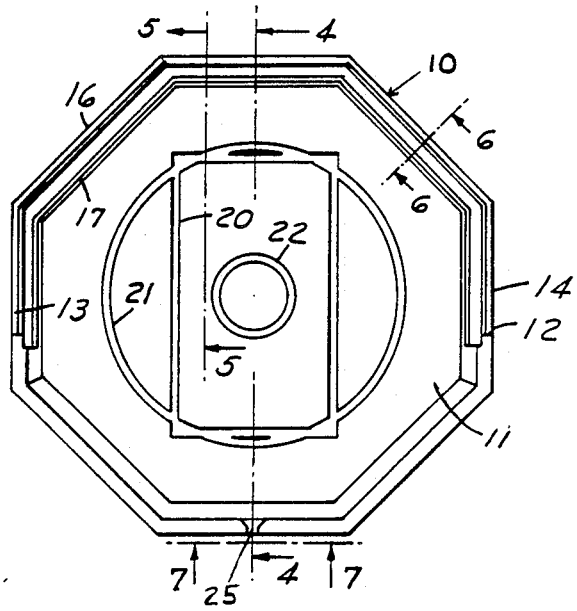
FIG. 3 is a rear view of the wall mounting bracket.
Figure 4:
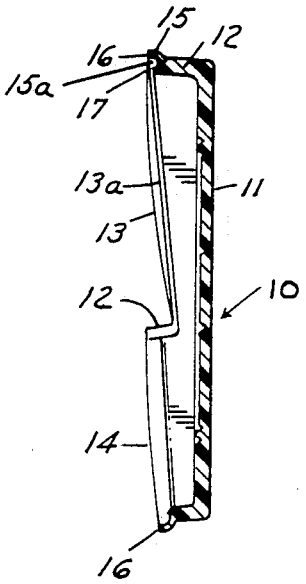
FIG. 4 is a sectional view taken along the line 4—4 in FIG. 3.
Figure 2:
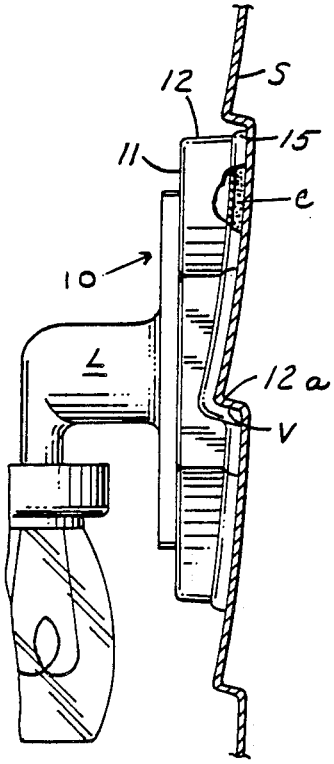
FIG. 2 is a sectional view taken along the line 2—2 in FIG. 1.
Figure 1:
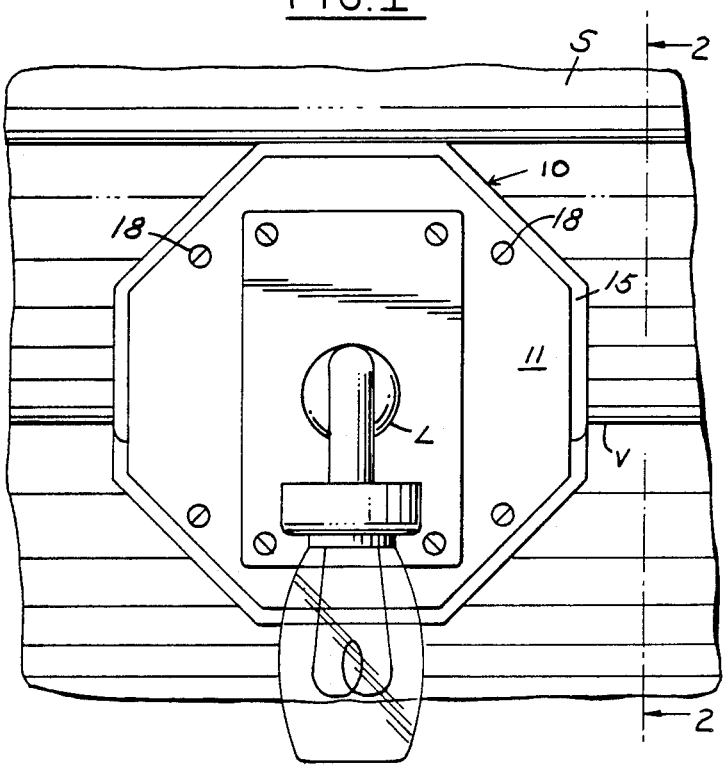
Figure 5:
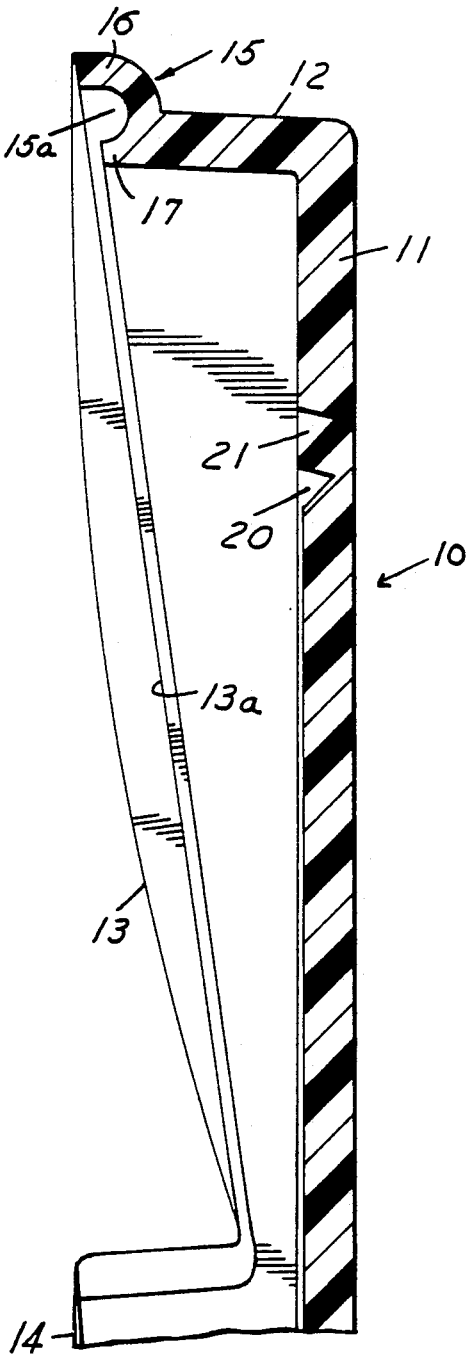
FIG. 5 is a fragmentary sectional view on an enlarged scale taken along the line 5—5 in FIG. 3.
Figure 6:
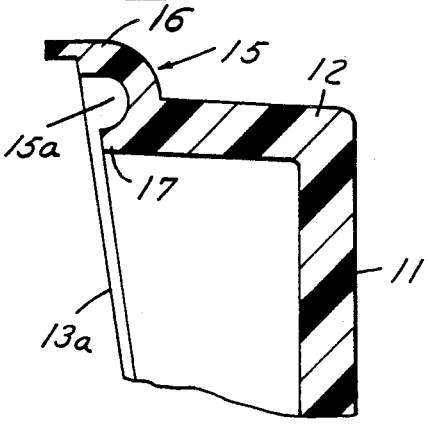
FIG. 6 is a fragmentary sectional view similar to FIG. 5 showing the bracket modified.
Figure 7:
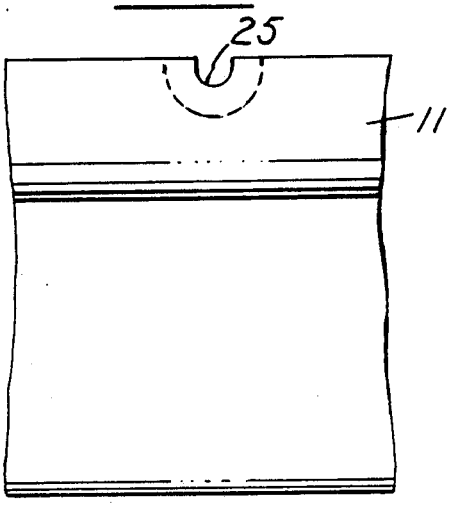
FIG. 7 is a fragmentary view on an enlarged scale 15 taken along the line 7—7 in FIG. 3.

Referring to FIGS. 1–4, in accordance with the invention, a wall mounting bracket 10 is adapted to be mounted on siding S which has vertically spaced shoulders V.

The wall mounting bracket 10 comprises a one piece plastic body, such as polypropylene, that includes a front wall 11 and a peripheral wall 12 having a free edge. Diametrically opposed side portions of the free edge of peripheral wall 12 of the wall 11 are provided with notches **12*a* and siding engaging surfaces 13, 14. (FIG. 4) Each of the surfaces 13, 14 is preferably convex to engage firmly the siding S. The portions of the wall with the surface 13, 14 have shoulders 13*a*, 14*a*** defining lines of severance markings providing a straight line along which the side wall portions can be cut to form straight edges for engaging rigid straight siding such as wood or insulated siding.

The free edge of the wall 12 is formed with an enlarged bead 15 that extends circumferentially about the wall and radially outwardly therefrom. The bead 15 comprises an outer lip 16 and an inner lip 17 defining a groove 152 for receiving caulking compound. The lip 17 extends only along the top and side wall portions of the wall 11. The axial extent of the inner lip 17 is less than that of the lip 16 to that at any excess caulking compound C (FIG. 2), will be extruded radially inwardly of the peripheral wall 12.

The bracket 10 is mounted to the siding by screws 18 through the wall 11. The interior of the wall 11 is formed with grooves 20, 21, 22 that define areas that can be cut out of the wall to accommodate the use to which the wall mounting bracket is to be placed. For example, the wall mounting bracket may accommodate lamps L, passages for water pipes wires or vents for hot air from a dryer. A drain opening 25, defined by a slot, is preferably provided in the lower portion of the wall 11.

When in position on the siding, any rain water flows downwardly onto the top of wall 11 and water is prevented from flowing inwardly by bead 15 at the juncture of the panel and the notch in the siding.

It can be seen that there has been provided an improved wall bracket which engages and accommodates the configuration of the siding on the building and which firmly engages the siding of the building to prevent the entry of water between the bracket and the siding.

We claim:

1. A one piece wall mounting bracket adapted to be mounted on plastic siding comprising a plastic body including a front wall and an integral peripheral wall extending from the front wall and having a free edge, diametrically opposed portions of the free edge of the peripheral wall being inclined and formed with notches, and said inclined edges being convex to firmly engage the plastic siding and accommodate any concavity in the siding.

2. The one piece wall bracket set forth in claim 1 wherein said diametrically opposed portions include indicia defining a straight line on the inner surfaces thereof along which said opposed portions can be cut to form straight edges for engaging rigid siding.

3. A one piece wall mounting bracket for application on siding on a wall of a building comprising a plastic body including a front wall and an integral peripheral wall extending from the front wall and having a free edge, diametrically opposed portions of the free edge of the peripheral wall being formed with notches defining inclined edges, and a radially outwardly extending bead on at least the upper portion of the peripheral wall to prevent the entry of water between the bracket and the siding.

4. A one piece wall mounting bracket for application on siding on a wall of a building comprising a plastic body including a front wall and an integral peripheral wall extending from the front wall and having a free edge, diametrically opposed portions of the free edge of the peripheral wall being formed with notches defining inclined edges, said edges being convex to firmly engage the siding, the free edge of the wall being formed with a groove for receiving caulking compound.

5. The one piece wall bracket set forth in claim 4 wherein the groove is defined by a radially extending bead on the free edge which includes spaced walls forming said groove.

6. A one piece wall mounting bracket for application on siding on a wall of a building comprising a plastic body including a front wall and an integral peripheral wall extending from the front wall and having a free edge, diametrically opposed portions of the free edge of the peripheral wall being formed with notches defining inclined edges, said edges being convex to firmly engage the siding, said diametrically opposed portions including indicia defining a straight line of the inner surfaces thereof along which said opposed portions can be cut to form straight edges for engaging rigid siding.

7. The one piece wall bracket set forth in claim 6 wherein a lowermost portion of said peripheral wall has a drain opening therethrough.

8. A one piece wall mounting bracket comprising a plastic body including a front wall and an integral peripheral wall extending from the front wall and having a free edge, diametrically opposed portions of the free edge of the peripheral wall being formed with notches defining inclined edges for engaging siding on the wall of a building, said free edge of the peripheral wall being formed with a groove for receiving caulking compound, said groove being defined by a radially extending bead on the free edge which includes spaced walls forming said groove.

9. A one piece wall mounting bracket comprising a plastic body including a front wall and an integral peripheral wall extending from the front wall and having a free edge, diametrically opposed portions of the free edge of the peripheral wall being formed with notches defining inclined edges for engaging siding on the wall of a building, said diametrically opposed portions including indicia defining a straight line on the inner surfaces thereof along which said opposed portions can be cut to form straight edges for engaging rigid siding.

* * * * *